US007685741B2

(12) United States Patent
Friedman

(10) Patent No.: US 7,685,741 B2
(45) Date of Patent: Mar. 30, 2010

(54) MULTILAYERED FOOTWEAR

(75) Inventor: Eric D. Friedman, Gansevoort, NY (US)

(73) Assignee: The Grandoe Corporation, Gloversville, NY (US)

( * ) Notice: Subject to any disclaimer, the term of this patent is extended or adjusted under 35 U.S.C. 154(b) by 772 days.

(21) Appl. No.: 11/633,818

(22) Filed: Dec. 5, 2006

(65) Prior Publication Data

US 2007/0124960 A1 Jun. 7, 2007

Related U.S. Application Data

(60) Provisional application No. 60/742,507, filed on Dec. 5, 2005.

(51) Int. Cl.
*A43B 13/12* (2006.01)
*A43B 13/16* (2006.01)
*A43B 13/18* (2006.01)

(52) U.S. Cl. ..... 36/25 R; 36/30 R; 36/37

(58) Field of Classification Search ..... 36/30 R, 36/25 R, 28, 35 R, 37
See application file for complete search history.

(56) References Cited

U.S. PATENT DOCUMENTS 4,794,707 A * 1/1989 Franklin et al. ..... 36/107
5,077,915 A * 1/1992 Gross ..... 36/31
5,174,049 A * 12/1992 Flemming ..... 36/28
6,176,025 B1 * 1/2001 Patterson et al. ..... 36/28
6,381,875 B2 * 5/2002 Singer et al. ..... 36/28
7,200,955 B2 * 4/2007 Foxen ..... 36/25 R
7,237,346 B2 * 7/2007 Lebo ..... 36/28
7,278,226 B2 * 10/2007 Holden et al. ..... 36/35 R
7,380,353 B2 * 6/2008 Feller et al. ..... 36/76 R
2003/0061733 A1 * 4/2003 Karsten ..... 36/43

* cited by examiner

*Primary Examiner*—Marie Patterson
(74) *Attorney, Agent, or Firm*—Keith D. Nowak; Carter Ledyard & Milburn LLP

(57) ABSTRACT

A shoe comprising a foot retaining portion having a heel area and having an interior side, the interior side sized and shaped to hold a foot and including an upper portion, the upper portion optionally lined with a pliable material; a first exterior insole layer having therein a cut-out adjacent the heel area of the foot retaining portion, the first exterior inside layer having an interior surface forming the bottom of the foot retaining portion and that is lined with pliable material; a second exterior insole layer having a heel strike pad sized and shaped to fit within the cut-out of the first exterior insole layer, the heel strike pad comprised of a material that absorbs and disperses heel strike forces; a third exterior insole layer sized to fit the foot retaining portion and having therein a cut-out adjacent the heel area of the foot retaining portion, the third exterior insole layer comprised of a material that provides foot cushioning; a fourth exterior insole layer adjacent the third exterior insole layer comprised of a material that provides foot tactile stimulation when foot pressure is applied thereto; an outsole layer adjacent the fourth exterior insole layer comprised of a material that provides outsole flexibility and skid resistance, the outsole layer having a heel with an optional depression therein; and an optional heel strike pad sized and shaped to fit within the depression of the heel of the outsole layer and comprised of a material that absorbs and disperses heel strike forces.

17 Claims, 1 Drawing Sheet

MULTILAYERED FOOTWEAR

The present invention claims the benefit of U.S. Provisional Patent Application No. 60/742,507, filed Dec. 5, 2005, titled "Perfectsole Walking Shoe System."

BACKGROUND OF THE INVENTION

The subject invention generally pertains to footwear, and more specifically to a shoe or boot having multiple layers to provide foot comfort.

Shoes and other types of footwear are necessary to protect human feet from the external environment. However, this protection comes at a cost: comfort. Since humans began wearing shoes, we have been striving for the optimum balance of environmental protection and comfort.

In an effort to achieve the above balance, shoes have become more complex, including one or more different layers with each layer enhancing one of foot comfort and foot protection. While multiple layer shoes are generally known in the art, none of the known prior art shoes provide the specific multiple layer configuration of the subject invention that maximizes both foot comfort and foot protection.

SUMMARY OF THE INVENTION

The subject invention is for a multiple layer shoe, boot or sandal in which the outsole is made from EPR (ethylene-propylene-rubber) or a similar material. The bottom of the outsole has an additional piece of latex-gel in the heel strike area, cushioning the heel when walking. There is a TPR (thermal plastic rubber) honeycomb mid-sole, and a solid closed cell polyurethane foam (or latex) leather covered insole under the entire foot. The insole also has a latex-gel pad in the heel area. The combination of the EPR outsole with the latex-gel piece on the bottom, honeycomb latex mid-sole and the solid foam insole with the latex-gel in the heel strike area all acting in unison, combine to cushion the heel and the entire foot during walking more than any other shoe.

More specifically, the shoe or boot of the subject invention has the following layers:

- The first layer, closest to the foot, covers the insole and is constructed from leather—selected for its cushiony softness, breathability, and its lightweight durability.
- The second layer, built into the insole, is constructed of a latex gel (or similar material) and is strategically located in the heel strike area, to help absorb the heavy force of impact during walking.
- The third layer is the foundation for the insole itself, made from a closed cell polyurethane foam or a high density latex foam (or similar material). It provides further shock absorption and cushioning.
- The fourth layer is a honeycombed TPR material (or similar material) midsole located either in the heel or when the thickness of the outsole construction allows, the entire foot bed. The honeycombed construction increases comfort by decreasing the midsole weight while creating both a rebound cushioning and active massaging effect for the user.
- The fifth layer is an EPR (ethylene-propylene-rubber) (or similar material) outsole. The compound in this layer represents the latest technology for increasing comfort and protecting feet. It is lightweight, flexible, and resilient, yet extremely durable and provides excellent traction.
- An optional sixth and final comfort layer can also be added which is a latex gel (or similar material) component of the outsole which has been built into the heel striking area to cushion the heel further when walking.

In a preferred embodiment, the subject invention is for a shoe, boot or sandal comprising a foot retaining portion having a heel area and having an interior side, the interior side sized and shaped to hold a foot and including an upper portion, the upper portion lined if desired with a pliable material; a first exterior insole layer having therein a cut-out adjacent the heel area side of the foot retaining portion, the first exterior inside layer having an interior surface forming the bottom of the foot retaining portion that is lined with a pliable material; a second exterior insole layer having a heel strike pad sized and shaped to fit within the cut-out of the first exterior insole layer, the heel strike pad comprised of a material that absorbs and disperses heel strike forces; a third exterior insole layer sized to fit the foot retaining portion and having therein a cut-out adjacent the heel area of the foot retaining portion, the third exterior insole layer comprised of a material that provides foot cushioning; a fourth exterior insole layer adjacent the third exterior insole layer comprised of a material that provides foot tactile stimulation when foot pressure is applied thereto; an outsole layer adjacent the fourth exterior insole layer comprised of a material that provides outsole flexibility and skid resistance, the outsole layer having a heel with an optional depression therein; and an optional heel strike pad sized and shaped to fit within the depression of the heel of the outsole layer and comprised of a material that absorbs and disperses heel strike forces.

BRIEF DESCRIPTION OF THE DRAWINGS

The detailed description of the present invention is best understood with the accompanying drawings in which.

DETAILED DESCRIPTION OF THE INVENTION

Figure 1:
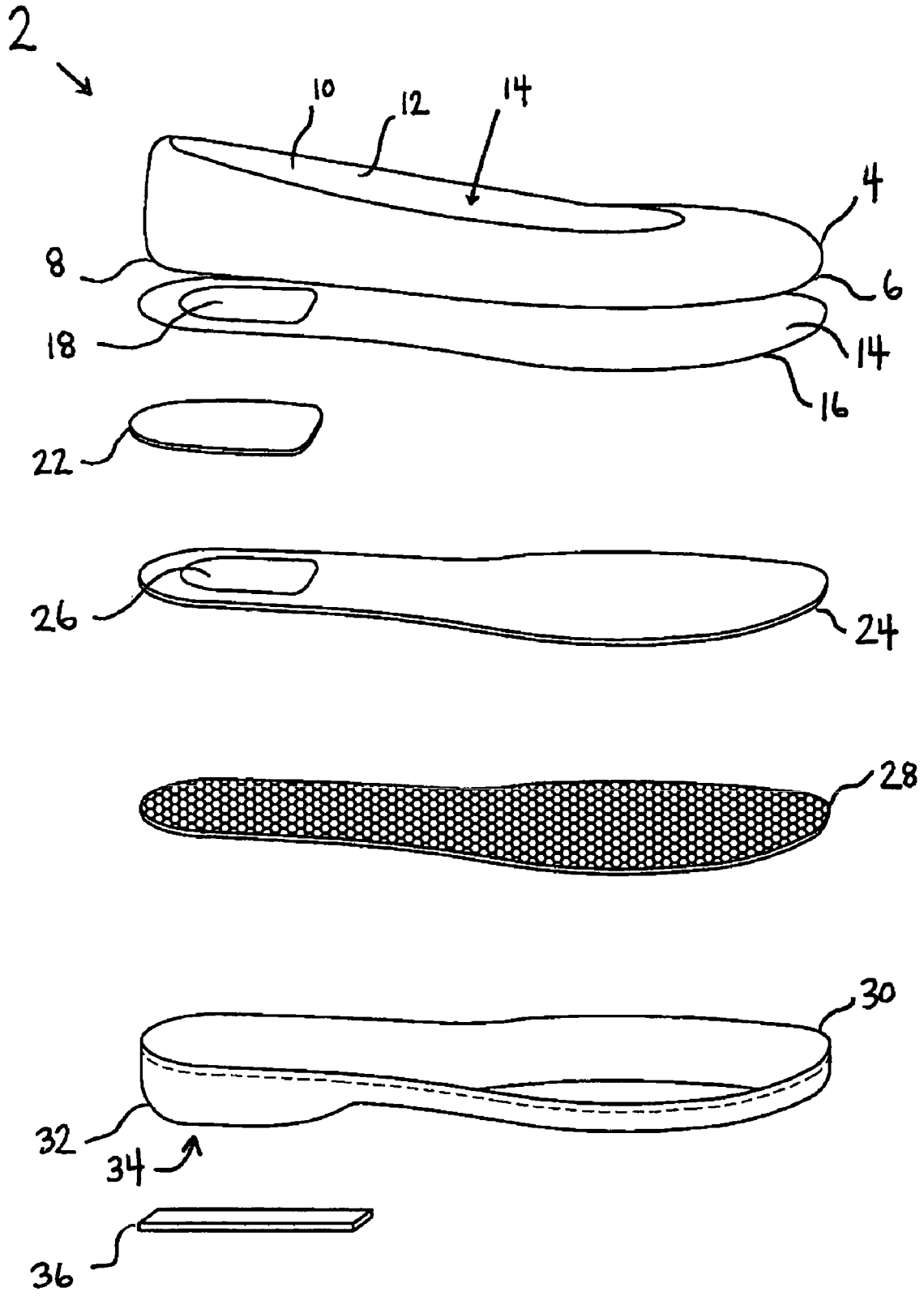
FIG. 1 is an exploded view of a shoe of the subject invention showing its multiple layer configuration.

Referring to FIG. 1, the subject invention pertains to multiple layer footwear, including, but not limited to, shoes, boots and sandals. Shoe 2 includes foot retaining portion 4 having an open underside 6 with a heel area 8, and having an interior side 10 sized and shaped to hold a foot. It is to be understood that the foot retaining portion can be a shell in the case of shoes or boots or a strap arrangement in the case of a sandal. The embodiment described herein is directed to a shoe but the invention is also applicable to boots or sandals. Interior side 10 has an upper portion 12. Upper portion 12 is lined with a pliable material 14. Preferably the pliable material is selected from natural leather or synthetic materials having the properties and qualities of leather (leather-like synthetic materials, herein).

Shoe 2 also includes first exterior insole layer 16 that is sized to fit foot retaining portion 4. First exterior insole layer 16 includes cut-out 18 adjacent heel area 8 of foot retaining portion 4. First exterior insole layer 16 has an interior surface forming the bottom of foot retaining portion 4 that is also lined with the same pliable material 14.

Shoe 2 further includes second exterior insole layer which is essentially comprised of heel strike pad 22. Heel strike pad 22 is sized and shaped to fit within cut out 18 of first exterior insole layer 16. Heel strike pad 22 is comprised of a material that absorbs and disposes heel strike forces. Preferably, heel strike pad 22 is comprised of a synthetic gel. Most preferably, the synthetic gel that comprises heel strike pad 22 is latex.

Shoe 2 additionally includes third exterior insole layer 24. Third exterior insole layer 24 includes cut-out 26 adjacent heel area 8 of foot retaining portion 4 and in alignment with cut-out 18 of first exterior insole layer 16 such that heel strike pad 22 fits between cut-out 18 and cut-out 26. Third exterior insole layer 24 is comprised of a material that provides foot cushioning. Preferably, third exterior insole layer 24 is comprised of a non-liquid foam. Most preferably, the non-liquid foam that comprises third exterior insole layer 24 is a closed cell polyurethane foam or latex foam.

Shoe 2 further includes fourth exterior insole layer 28 adjacent to third exterior insole layer 26. Fourth exterior insole layer 28 is comprised of a material that provides foot tactile stimulation when foot pressure is applied thereto. Preferably, fourth exterior insole layer 28 is comprised of a high density, TPR material having a honeycomb-like structure. Most preferably, the honeycomb construction for the midsole is made of TPR with a select hardness that allows the honeycomb walls to flex under the force of walking for shock absorption and energy rebound as the walls of the honeycomb resume their original shape after the compression of weight transfer. The midsole provides superior stability and support in addition to shock absorption. All of these characteristics of the midsole combine to create enhanced comfort not found in other types of footwear. The midsole of the present invention is more supportive than a thick foam midsole which collapses under the wearer's weight and does not provide the same combined level of rigidity, hardness, shock absorption and energy rebound.

Shoe 2 additionally includes outsole layer 30 adjacent fourth interior insole layer 28. Outsole layer 30 is comprised of a material that provides outsole flexibility and skid resistance. Preferably, the material that provides outsole layer 30 with the above properties includes ethylene, propylene and rubber. Outsole layer 30 includes heel 32 having depression 34 therein.

Shoe 2 optionally includes heel strike pad 36 that is sized and shaped to fit within depression 34 of heel 32 of outsole layer 30. Heel strike pad 36 is comprised of a material that absorbs and disperses heel strike forces. Preferably, heel strike pad 36 is comprised of a synthetic gel. Most preferably, the synthetic gel that comprises heel strike pad 36 is latex. Use of heel strike pad 36 is an optional feature which can be used in conjunction with the present invention if desired.

The invention described herein provides a new brand of footwear that features an innovative multi-density multi layer comfort system. The multi comfort layers are designed to provide ultimate comfort by working in unison to enhance footwear cushioning, flexibility, lightness and durability without detracting from support and stability which also contribute to comfort.

While the invention has been described with respect to the described embodiments in accordance therewith, it will be apparent to those skilled in the art that various modifications and improvements may be made without departing from the scope and spirit of the invention. For example, the material used to construct the various layers can be modified so long as there is no change in comfort, the size and shape of the heel pads may vary and the material for the upper portion of the inventive shoe can vary to accommodate various styles for both men and women.

The invention claimed is:

1. An article of footwear comprising:

a foot retaining portion having a heel area and having an interior side, the interior side sized and shaped to hold a foot and including an upper portion, the upper portion optionally lined with a pliable material;

a first exterior insole layer having therein a cut-out adjacent the heel area of the foot retaining portion, the first exterior insole layer having an interior surface forming the bottom of the foot retaining portion that is lined with a pliable material;

a second exterior insole layer having a heel strike pad sized and shaped to fit within the cut-out of the first exterior insole layer, the heel strike pad comprised of a material that absorbs and disperses heel strike forces;

a third exterior insole layer sized to fit the foot retaining portion and having therein a cut-out adjacent the heel area of the foot retaining portion in alignment with the cut-out of the first exterior insole layer, the third exterior insole layer comprised of a material that provides foot cushioning;

a fourth exterior insole layer adjacent the third exterior insole layer comprised of a material that provides foot tactile stimulation when foot pressure is applied thereto; and an outsole layer adjacent the fourth exterior insole layer comprised of a material that provides outsole flexibility and skid resistance, the outsole layer having a heel with a depression therein.

2. The article of footwear of claim 1 wherein the pliable material lining the upper portion of the foot retaining portion and the interior surface of the first exterior insole layer is at least one of leather or a leather-like synthetic material and further including providing a depression in a heel area of the outside layer with a heel strike pad sized and shaped to fit within the depression.

3. The article of footwear of claim 1 wherein the heel strike pad of the second exterior insole layer is comprised of a synthetic gel.

4. The article of footwear of claim 3 wherein the synthetic gel is latex.

5. The article of footwear of claim 1 wherein the third exterior insole layer is comprised of non-liquid foam.

6. The article of footwear of claim 5 wherein the non-liquid foam is comprised of closed cell polyurethane foam.

7. The article of footwear of claim 1 wherein fourth exterior insole layer is comprised of a high density, material having a honey comb-like structure.

8. The article of footwear of claim 7 wherein the high density, material is thermal plastic rubber.

9. The article of footwear of claim 1 wherein the outsole layer is comprised of a material that includes ethylene, propylene and rubber.

10. The article of footwear of claim 2 wherein the heel strike pad sized and shaped to fit within the depression of the heel of the outsole layer is comprised of a synthetic gel.

11. The article of footwear of claim 10 wherein the synthetic gel is latex.

12. An article of footwear comprising:

a foot retaining portion having a heel area and having an interior side, the interior side sized and shaped to hold a foot and including an upper portion, the upper portion lined with a pliable material wherein the pliable material lining the upper portion of the foot retaining portion is at least one of leather or a leather-like synthetic material;

a first exterior insole layer having therein a cut-out adjacent the heel area of the foot retaining portion, the first exterior insole layer having an interior surface forming the bottom of the foot retaining portion and that is lined with a pliable material that is made from one of leather or a leather-like synthetic material;

a second exterior insole layer having a heel strike pad sized and shaped to fit within the cut-out of the first exterior insole layer, the heel strike pad comprised of a material that absorbs and disperses heel strike forces wherein the heel strike pad of the second exterior insole layer is comprised of a synthetic gel;

a third exterior insole layer sized to fit the foot retaining portion and having therein a cut-out adjacent the heel area of the foot retaining portion in alignment with the cut-out of the first exterior insole layer, the third exterior insole layer comprised of a material that provides foot cushioning wherein the third exterior insole layer is comprised of non-liquid foam;

a fourth exterior insole layer adjacent the third exterior insole layer comprised of a material that provides foot tactile stimulation when foot pressure is applied thereto wherein fourth exterior insole layer is comprised of a high density, material having a honey comb-like structure; and an outsole layer adjacent the fourth exterior insole layer comprised of a material that provides outsole flexibility and skid resistance, the outsole layer comprised of a material that includes ethylene, propylene and rubber.

13. The article of footwear of claim 12 wherein the synthetic gel of the heel strike pad of the second exterior insole layer is latex.

14. The article of footwear of claim 12 wherein the non-liquid foam of the third exterior insole layer is latex.

15. The article of footwear of claim 12 wherein the high density, material of the fourth exterior insole layer is thermal plastic rubber.

16. The article of footwear of claim 12 wherein there is further provided a synthetic gel heel strike pad sized and shaped to fit within a depression provided in the heel of the outsole layer.

17. An article of footwear comprising:

a foot retaining portion having a heel area and having an interior side, the interior side sized and shaped to hold a foot and including an upper portion, the upper portion lined with a pliable material wherein the pliable material lining the upper portion of the foot retaining portion is comprised of leather or leather-like synthetic material;

a first exterior insole layer having therein a cut-out adjacent the heel area of the foot retaining portion, the first exterior insole layer having an interior surface forming the bottom of the foot retaining portion that is lined with a pliable material that is comprised of leather or leather-like synthetic material;

a second exterior insole layer having a heel strike pad sized and shaped to fit within the cut-out of the first exterior insole layer, the heel strike pad comprised of a material that absorbs and disperses heel strike forces wherein the heel strike pad of the second exterior insole layer is comprised of a latex gel;

a third exterior insole layer sized to fit the foot retaining portion and having therein a cut-out adjacent the heel area of the foot retaining portion in alignment with the cut-out of the first exterior insole layer, the third exterior insole layer comprised of a material that provides foot cushioning wherein the third exterior insole layer is comprised of non-liquid foam;

a fourth exterior insole layer adjacent the third exterior insole layer comprised of a material that provides foot tactile stimulation when foot pressure is applied thereto wherein fourth exterior insole layer is comprised of a high density, material having a honey comb-like structure;

an outsole layer adjacent the fourth exterior insole layer comprised of a material that provides outsole flexibility and skid resistance, the outsole layer having a heel with an depression therein wherein the outsole layer is comprised of a material that includes ethylene, propylene and rubber; and an heel strike pad sized and shaped to fit within the depression of the heel of the outsole layer and comprised of a material that absorbs and disperses heel strike forces wherein the heel strike pad sized and shaped to fit within the depression of the heel of the outsole layer is comprised of a latex gel.

* * * * *